United States Patent [19]

Häberle et al.

[11] Patent Number: 4,671,548

[45] Date of Patent: Jun. 9, 1987

[54] LOCK FOR PIVOTABLE HOODS OR THE LIKE FOR MOTOR VEHICLES

[75] Inventors: Fritz Häberle, Sindelfingen; Götz Mötting; Walter Münsinger, both of Böblingen; Franz Waschitschek, Sindelfingen, all of Fed. Rep. of Germany

[73] Assignee: Daimler-Benz Aktiengesellschaft, Fed. Rep. of Germany

[21] Appl. No.: 784,052

[22] Filed: Oct. 4, 1985

[30] Foreign Application Priority Data

Oct. 4, 1984 [DE] Fed. Rep. of Germany ..... 3436318

[51] Int. Cl.[4] ..... E05B 9/06

[52] U.S. Cl. ..... 292/216; 70/240; 70/466; 292/337; 292/DIG. 14; 292/DIG. 42; 292/DIG. 53; 292/DIG. 64

[58] Field of Search ..... 292/DIG. 53, DIG. 60, 292/DIG. 55, DIG. 64, 337, DIG. 37, DIG. 14, 216, DIG. 42, DIG. 43, DIG. 29; 70/451, 461, 466, 240; 296/76; 180/69.21

[56] References Cited

U.S. PATENT DOCUMENTS

| | | | |
|---|---|---|---|
| 1,003,956 | 9/1911 | Voight | 292/DIG. 60 X |
| 2,309,049 | 1/1943 | Curtiss et al. | 292/337 |
| 2,605,630 | 8/1952 | Keeler | 292/336.3 |
| 2,885,880 | 5/1959 | Muttart | 292/337 |
| 2,930,645 | 3/1960 | Dall | 292/DIG. 43 X |
| 3,606,422 | 9/1971 | Hennessy | 70/451 X |
| 4,073,170 | 2/1978 | Miyabayashi et al. | 292/216 X |
| 4,420,281 | 12/1983 | Dehoff | 411/418 X |

FOREIGN PATENT DOCUMENTS

| | | | |
|---|---|---|---|
| 1933996 | 11/1965 | Fed. Rep. of Germany . | |
| 449333 | 12/1967 | Switzerland | 411/418 |

*Primary Examiner*—Robert L. Wolfe
*Assistant Examiner*—Lloyd A. Gall
*Attorney, Agent, or Firm*—Barnes & Thornburg

[57] ABSTRACT

A lock assembly is disclosed for locking pivotable hoods, flaps or the like of motor vehicles, which lock assembly has a displaceable closing cylinder, a handle key, a detent pawl and a rotary latch. To ensure that a closure of this type is adjusted quickly and accurately during assembly, the closing cylinder and handle key on the one hand and the detent pawl and rotary latch on the other hand are arranged in separate housings, and the two housings have guides in which they are displaceable relative to one another on overcoming a frictional force.

5 Claims, 2 Drawing Figures

LOCK FOR PIVOTABLE HOODS OR THE LIKE FOR MOTOR VEHICLES

BACKGROUND AND SUMMARY OF THE INVENTION

The invention relates to a lock, especially for pivotable bonnets, hoods flaps or the like of motor vehicles. More specifically the invention relates to such locks of the type having a displaceable closing cylinder, a handle key, a detent pawl and a rotary latch.

It is difficult to adjust locks of this type when they are being assembled, because, on the one hand, exact gap widths between body parts adjacent to one another have to be maintained and, on the other hand, the lock is accessible only when the hood or other pivotable member is opened. Consequently, several attempts at adjustment are often necessary, until the exact position of the lock is determined.

An object on which the present invention is based was, therefore, to avoid this disadvantage and provide a lock which guarantees accurate and rapid assembly.

In a lock of the type defined in the introduction, this object is achieved according to the invention by providing that the closing cylinder and handle key on the one hand and the detent pawl and rotary latch on the other hand are arranged in separate housings, with the two housings having guides in which they are displaceable relative to one another on overcoming a frictional force.

In particular advantageous embodiments of the invention, the relative adjusting displacement between the separate housings takes place perpendicularly to the longitudinal center axis of the closing cylinder.

Preferred contemplated embodiments of the guides are configured so that the frictional force is greater than the counterpressure of an elastic gasket at the hood or flap being locked. In especially preferred embodiments the guides are configured as guide pins at one of the housings, which guide pins are guided in guide channels at the other of the housings.

Other objects, advantages and novel features of the present invention will become apparent from the following detailed description of the invention when considered in conjunction with the accompanying drawings.

DETAILED DESCRIPTION OF THE DRAWINGS

Figure 1:
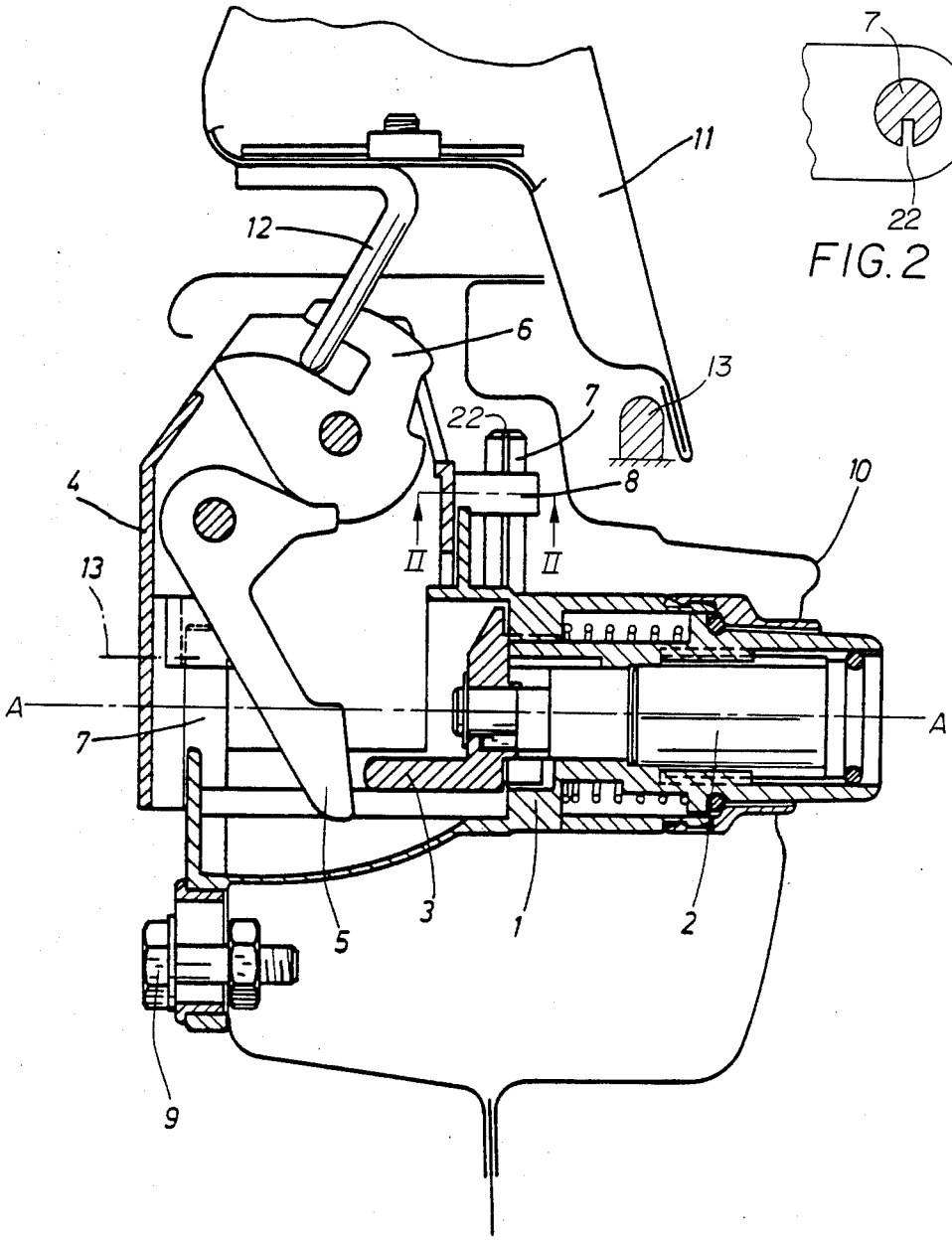
FIG. 1 is a schematic side sectional view showing a lock constructed in accordance with a preferred embodiment of the invention in use with a passenger vehicle tailgate.
Figure 2:
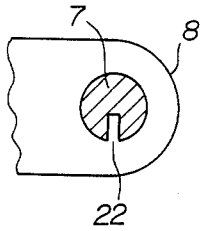
FIG. 2 shows a cross section of the guide pin taken along line II—II of FIG. 1.

The lock illustrated has, in a first housing 1, a press-in closing cylinder 2 and a handle key 3 and, in a second housing 4, a detent pawl 5 and a rotary latch 6. To guide the housings 1 and 4 relative to one another, guide pins 7 project from the housing 1 and interact with guide channels in the form of bores in parts of the housing 4, for example in a projecting bracket 8. According to certain preferred embodiments the guide pins 7 are made slotted at 21 to achieve a specific frictional force. By means of the slots the pins are frictionally and compressionally held in the brackets 8 as shown in FIG. 2.

The lock arrangement according to the invention is assembled as follows:

First, the housing 1 of the closing cylinder 2 is fastened behind the rear center piece 10 of the vehicle by means of the screw connection 9. The housing 4 is then pressed onto the outer ends of the guide pins 7 at right angles to the center line A—A of the cylinder 2.

The closing shackle 12 which interacts with the rotary latch 6 is prefitted in the tailgate 11 by means of a screw connection tightened only with a slight torque.

The tailgate 11 is then swung shut, and on the one hand the closing shackle 12 assumes its desired position as a result of interaction with the rotary latch. On the other hand, the housing 4 is adjusted along the pins 7 at the same time as the tailgate 11 is adjusted when the latter is pulled up or pressed down at the lateral connection points of the vehicle mudguards or gaskets at the tailgate periphery. After the tailgate 11 is opened, the housing 4 can finally be fastened on the inside to the rear center piece 10 via a screw connection 13, and the screw connection of the closing shackle 12 can likewise be tightened finally.

The guide pins are to be configured so that the shifting force is greater than the counterpressure of the tailgate gasket 13 in order to complete precise adjustment of the lock exactly.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. In a lock assembly for pivotable hoods, flaps or the like of motor vehicles which abut a gasket on the motor vehicle when in a closed position, the improvement comprising a displaceable closing cylinder, a handle key, a detent pawl and a rotary latch mountable on the motor vehicle and engageable with a shackle mounted at the hoods or flaps, wherein the closing cylinder and handle key on the one hand and the detent pawl and rotary latch on the other hand are arranged in separate housings, with one housing mounted on the vehicle and the other housing slidely mounted to the one housing by interengageable adjustment guides which are displaceable relative to one another on overcoming a friction force therebetween to provide automatic and continuous adjustment of the position of the other housing with respect to the one housing during installation of the lock assembly on a vehicle after which the other housing is mounted to the vehicle.

2. Lock assembly accroding to claim 1, wherein the separate housings and the guides are configured such that the displacement of the housings with respect to one another takes place perpendicularly relative to a longitudinal center axis of the closing cylinder.

3. Lock assembly according to claim 1, wherein the frictional force at the housing guides is greater than a counterpressure of the elastic gasket on the hood or flap.

4. Lock assembly according to claim 1, wherein the guides include guide pins at the housing for the closing cylinder and handle key, and guide channels assigned to the guide pins at the other housing.

5. Lock assembly according to claim 4, wherein the guide pins are slotted to facilitate application of said frictional force.

* * * * *